US011781237B2

(12) United States Patent
Unal et al.

(10) Patent No.: US 11,781,237 B2
(45) Date of Patent: Oct. 10, 2023

(54) METHODS OF PREPARING 7XXX ALUMINUM ALLOYS FOR ADHESIVE BONDING, AND PRODUCTS RELATING TO THE SAME

(71) Applicant: ARCONIC TECHNOLOGIES LLC, Pittsburgh, PA (US)

(72) Inventors: Ali Unal, Export, PA (US); June M. Epp, Pittsburgh, PA (US); James M. Marinelli, Murrysville, PA (US); Marissa Menanno, Latrobe, PA (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 23 days.

(21) Appl. No.: 17/849,370

(22) Filed: Jun. 24, 2022

(65) Prior Publication Data

US 2022/0333265 A1 Oct. 20, 2022

Related U.S. Application Data

(60) Division of application No. 16/542,678, filed on Aug. 16, 2019, which is a continuation of application No. PCT/US2018/020979, filed on Mar. 5, 2018.

(60) Provisional application No. 62/467,652, filed on Mar. 6, 2017.

(51) Int. Cl.

| | |
|---|---|
| ***C25D 11/24*** | (2006.01) |
| ***C25D 11/08*** | (2006.01) |
| ***C25D 11/16*** | (2006.01) |

(52) U.S. Cl.

CPC ..... *C25D 11/24* (2013.01); *C25D 11/08* (2013.01); *C25D 11/16* (2013.01)

(58) Field of Classification Search

None

See application file for complete search history.

(56) References Cited

U.S. PATENT DOCUMENTS

| | | | | |
|---|---|---|---|---|
| 5,126,210 A * | 6/1992 | Wieserman | ..... | C25D 11/10 430/278.1 |
| 5,277,788 A * | 1/1994 | Nitowski | ..... | C25D 11/12 205/175 |
| 2016/0319440 A1* | 11/2016 | Bull | ..... | C23G 1/12 |

* cited by examiner

*Primary Examiner* — Seth Dumbris

(74) *Attorney, Agent, or Firm* — GREENBERG TRAURIG, LLP

(57) ABSTRACT

Methods of preparing 7xxx aluminum alloy products for adhesive bonding and products made therefrom are disclosed. Generally, the methods include preparing a 7xxx aluminum alloy product for anodizing, then anodizing the 7xxx aluminum alloy product, and then contacting the anodized 7xxx aluminum alloy product with an appropriate chemical to create a functionalized layer. The new 7xxx aluminum alloy products may realize improved shear bonding performance.

20 Claims, 10 Drawing Sheets

Functionalized Surface

Phosphoric Acid Anodized Surfaces

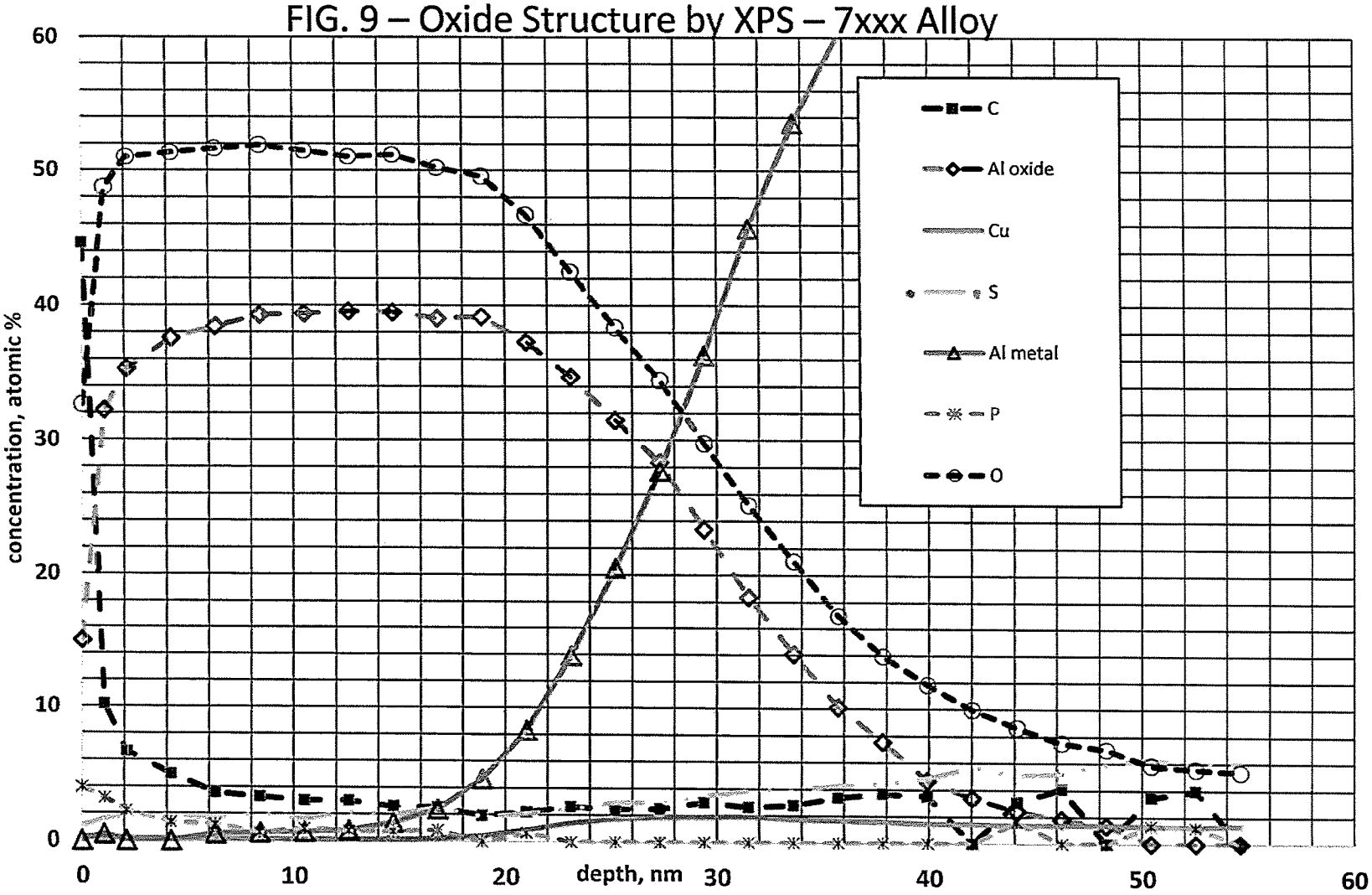
FIG. 9 – Oxide Structure by XPS – 7xxx Alloy

METHODS OF PREPARING 7XXX ALUMINUM ALLOYS FOR ADHESIVE BONDING, AND PRODUCTS RELATING TO THE SAME

CROSS-REFERENCE TO RELATED APPLICATIONS

This application is a divisional of U.S. patent application Ser. No. 16/542,678, filed Aug. 16, 2019, which is a continuation of International Patent Application No. PCT/US2018/020979, filed Mar. 5, 2018, which claims the benefit of priority of U.S. Patent Application No. 62/467,652, filed Mar. 6, 2017, each of which is incorporated herein by reference in its entirety.

BACKGROUND

7xxx aluminum alloys are aluminum alloys having zinc and magnesium as their primary alloying ingredients, besides aluminum. It would be useful to facilitate adhesive bonding of 7xxx aluminum alloys to itself and other materials (e.g., for automotive applications).

SUMMARY OF THE INVENTION

Broadly, the present disclosure relates to methods of preparing 7xxx aluminum alloys for production of a functionalized layer thereon (e.g., for adhesive bonding) and 7xxx aluminum alloy products relating thereto. Referring now to FIGS. 1-2, a method may comprise an optional receiving step (100), wherein a 7xxx aluminum alloy product (1) having a 7xxx aluminum alloy base (10) with a surface oxide layer (20) thereon is received. The surface oxide layer (20) (sometimes referred to herein as the as-received oxide layer) generally has an as-received thickness, generally from 5 nm to 60 nm thick, depending on its temper. Products shipped in the W-temper or T-temper may have a thicker as-received thickness (e.g., from about 20 to 60 nanometer), whereas F-temper products may have a thinner as-received oxide thickness (e.g., from about 5 to 20 nanometers). While the surface oxide layer (20) is illustrated as being generally uniform, the surface oxide layer generally has a non-uniform topography.

Still referring to FIGS. 1-2, the 7xxx aluminum alloy product (1) may be prepared (200) for anodizing. The preparing step (200) generally comprises reducing the thickness of and/or eliminating the as-received surface oxide layer (20). The preparing step (200) may also remove a small portion of the top layer of the 7xxx aluminum alloy base (e.g., a few nanometers) and/or may remove any intermetallic particles (e.g., dominant copper-bearing intermetallic particles, such as $Al_7Cu_2Fe$ particles) contained in the as-received 7xxx aluminum alloy product. Upon conclusion of the preparing step (200), the 7xxx aluminum alloy product generally comprises a prepared oxide layer (30) (FIG. 4). This prepared oxide layer (30) is thinner than the as-received oxide layer (20), generally having an average (mean) thickness of about 5-10 nanometers thick, or thereabouts. The prepared oxide layer (30) also generally comprises a non-uniform (e.g., scalloped) topography. This prepared oxide layer (30) generally facilitates the subsequent anodizing (300) and creating a functional layer (400) steps.

In one embodiment, and referring now to FIGS. 3-4, the preparing step (200) includes a cleaning step (210) and an oxide removal step (220). When employed, the cleaning step (210) generally includes contacting the 7xxx aluminum alloy product with a proper solvent (e.g., an organic solvent, such as acetone or hexane) followed by an alkaline or acid clean. This cleaning step facilitates removal of debris, lubricant(s) and other items on the surface of the as-received 7xxx aluminum alloy product that might inhibit or disrupt the subsequent oxide removal step (220). In one embodiment, after application of the solvent, the surface is rinsed and then exposed to an alkaline cleaner, until the surface is "water-break free" (e.g., is uniformly wetted by water, such as when a contact angle of zero (0) degrees is achieved and/or when a surface tension of at least 0.072 N/m is achieved).

After the cleaning step (210), the 7xxx aluminum alloy product is generally subjected to an oxide removal step (220), which thins and/or removes the oxide layer (20). The oxide removal step (220) may comprise, for instance, exposing the cleaned 7xxx aluminum alloy surface to a caustic solution (e.g., NaOH), then rinsing, then exposing the 7xxx aluminum alloy surface to an acidic solution (e.g., nitric acid), and then rinsing again. Other types of oxide thinning methodologies may be employed. After the oxide removal step (220), little or none of the as-received surface oxide layer is present on the 7xxx aluminum alloy body surface. After the oxide thinning, the 7xxx aluminum alloy product generally comprises a prepared oxide layer (30). This prepared oxide layer (30) is thinner than the as-received oxide layer (20), generally having an average (mean) thickness of about 5-10 nanometers, or thereabouts. The prepared oxide layer (30) also generally comprises a non-uniform (e.g., scalloped) topography. This prepared oxide layer generally (30) facilitates the subsequent anodizing (300) and creating a functional layer (400) steps.

Referring now to FIGS. 5-6, after the preparing step (200), the prepared 7xxx aluminum alloy body is subjected to a short anodizing step to produce a thin anodic oxide layer (40) on the prepared oxide layer (30) created as a result of the preparing step (200). The anodizing step (300) is generally a single-step anodizing, and generally comprises exposing the prepared 7xxx aluminum alloy body prepared in step (200) to anodizing conditions sufficient to produce (e.g., grow) the thin anodic oxide layer (40) on top of the prepared oxide layer (30). A single-step anodizing is where generally the same anodizing conditions are used throughout the anodizing, resulting in the production of a single, generally homogeneous, anodic oxide layer. The anodic oxide layer (40) generally comprises a near stoichiometric film of $Al_2O_3$ located on the surface of the prepared oxide layer (30). In one embodiment, the thin anodic oxide layer (40) has a thickness of from 10 to 145 nanometers. After the anodizing, the 7xxx aluminum alloy product may be rinsed with water.

The thickness of the anodic oxide layer (40) may be measured by XPS (X-ray Photoelectron Spectroscopy) using a sputter rate relative to an aluminum oxide standard having a verified oxide thickness. For instance, the oxide thickness may be determined based on a sputter rate relative to a measured thickness of $Al_2O_3$ that was determined using a commercially available $SiO_2$ sputter-rate standard, which may have a known thickness of 50 nm or 100 nm, for instance. The aluminum oxide standard material may be an $Al_2O_3$ layer that was deposited via e-beam evaporation onto a silicon wafer, and may have a corresponding thickness of 50 nm or 100 nm, for instance. The relative ratio of the $SiO_2/Al_2O_3$ sputtering is approximately 1.6.

The anodizing conditions used to produce the thin anodic oxide layer (40) may vary depending on the acidic electrolyte solution used. In one embodiment, the acidic electrolyte solution comprises one of sulfuric acid, phosphoric acid, chromic acid, and oxalic acid. In one embodiment, the anodizing solution consists essentially of sulfuric acid (e.g., is essentially a 10-20 wt. % sulfuric acid solution). In another embodiment, the anodizing solution consist essentially of phosphoric acid (e.g., is essentially a 5-20 wt. % phosphoric acid solution). In yet another embodiment, the anodizing solution consist essentially of chromic acid. In another embodiment, the anodizing solution consist essentially of oxalic acid. In one embodiment, the anodizing solution has a temperature of from 60 to 100° F. during anodizing. In one embodiment, the anodizing solution has a temperature of at least 65° F. during anodizing. In another embodiment, the anodizing solution has a temperature of at least 70° F. during anodizing. In one embodiment, the anodizing solution has a temperature of not greater than 95° F. during anodizing. In another embodiment, the anodizing solution has a temperature of not greater than 90° F. during anodizing.

After the anodizing step (300), the combined thickness of the prepared oxide layer (30) and the anodic oxide layer (40) should be at least 15 nanometers thick, but not greater than 150 nanometers thick (i.e., the combined thickness of layer (30) plus layer (40) should be from 15-100 nanometers). As described in further detail below, in step (400), a functionalized layer is created after the anodizing step (300). This creating step (400) includes exposing the anodized 7xxx aluminum alloy product to an appropriate phosphorous-containing organic acid (e.g., an organophosphoric or an organophosphonic acid). If the combined thickness of the prepared oxide layer (30) and the anodic oxide layer (40) is less than 15 nanometers thick, then insufficient penetration of phosphorous may occur in the creating step (400). If the combined thickness of the prepared oxide layer (30) and the anodic oxide layer (40) is more than 150 nanometers thick, then adhesive bonding performance (after the creating step (400)) may be degraded.

In one embodiment, the combined thickness of the prepared oxide layer (30) and the anodic oxide layer (40) is at least 20 nanometers. In another embodiment, the combined thickness of the prepared oxide layer (30) and the anodic oxide layer (40) is at least 25 nanometers. In one embodiment, the combined thickness of the prepared oxide layer (30) and the anodic oxide layer (40) is not greater than 135 nanometers thick. In another embodiment, the combined thickness of the prepared oxide layer (30) and the anodic oxide layer (40) is not greater than 125 nanometers thick. In yet another embodiment, the combined thickness of the prepared oxide layer (30) and the anodic oxide layer (40) is not greater than 115 nanometers thick. In another embodiment, the combined thickness of the prepared oxide layer (30) and the anodic oxide layer (40) is not greater than 105 nanometers thick. In yet another embodiment, the combined thickness of the prepared oxide layer (30) and the anodic oxide layer (40) is not greater than 100 nanometers thick. In another embodiment, the combined thickness of the prepared oxide layer (30) and the anodic oxide layer (40) is not greater than 95 nanometers thick. In yet another embodiment, the combined thickness of the prepared oxide layer (30) and the anodic oxide layer (40) is not greater than 90 nanometers thick. In another embodiment, the combined thickness of the prepared oxide layer (30) and the anodic oxide layer (40) is not greater than 85 nanometers thick. In yet another embodiment, the combined thickness of the prepared oxide layer (30) and the anodic oxide layer (40) is not greater than 80 nanometers thick. In another embodiment, the combined thickness of the prepared oxide layer (30) and the anodic oxide layer (40) is not greater than 75 nanometers thick. In yet another embodiment, the combined thickness of the prepared oxide layer (30) and the anodic oxide layer (40) is not greater than 70 nanometers thick. In another embodiment, the combined thickness of the prepared oxide layer (30) and the anodic oxide layer (40) is not greater than 65 nanometers thick, or thinner.

Still referring to FIGS. 5-6, in one embodiment, the anodizing step (300) comprises anodizing in an appropriate acidic solution (e.g., sulfuric acid) for a time sufficient and under conditions sufficient to create the anodic oxide layer (40). In one approach, the current density is from 5-20 amperes per square foot (ASF), and the anodizing time is not greater than 120 seconds, depending on the current density employed. In one embodiment, the anodizing comprises anodizing in sulfuric acid (e.g., a 10-20 wt. % sulfuric acid solution), at room temperature, and at 15 ASF for 10 to 40 seconds, or similar conditions, as required to facilitate production of the anodic oxide layer of suitable thickness. In another embodiment, the anodizing comprises anodizing in sulfuric acid, at room temperature, at 12 ASF for 10 to 60 seconds. In another embodiment, the anodizing comprises anodizing in sulfuric acid, at room temperature, at 6 ASF for 10 to 60 seconds. In one embodiment, the sulfuric acid solution has a concentration of 12-18 wt. % sulfuric acid. In another embodiment, the sulfuric acid solution has a concentration of 14-16 wt. % sulfuric acid. In another embodiment, the sulfuric acid solution is an about 15 wt. % sulfuric acid solution. Other appropriate sulfuric anodizing conditions can be used.

In another approach (not illustrated), the anodizing step (300) comprises anodizing in an appropriate phosphoric acid solution for a time sufficient and under conditions sufficient to create the anodic oxide layer (40). In one embodiment, the voltage applied is from 10-20 volts, and the anodizing time is not greater than 120 seconds. In one embodiment, the anodizing comprises anodizing in phosphoric acid (e.g., a 5-20 wt. % phosphoric acid solution) having a temperature of from 80-100° F. (e.g., 90° F.) and at 13-18 volts for 10 to 60 seconds, or similar conditions, as required to facilitate production of the anodic oxide layer of suitable thickness. Other appropriate phosphoric anodizing conditions can be used.

After the anodizing step (300) and any appropriate intervening steps (e.g., rinsing), the method may include creating a functional layer (400) via an appropriate chemical (e.g., a phosphorus-containing organic acid). In one embodiment, the creating step (400) may include contacting the anodized 7xxx aluminum alloy product with any of the phosphorus-containing organic acids disclosed in U.S. Pat. No. 6,167,609 to Marinelli et al., which is incorporated herein by reference. A layer of polymeric adhesive may then be applied to the functionalized layer (e.g., for joining to a metal support structure to form a vehicle assembly). The creating step (400) may alternatively use conversion coatings in lieu of a phosphoric containing organic acid. For instance, conversion coatings employing titanium or titanium with zirconium may be used. Thus, in one embodiment, after anodizing, the anodic oxide layer is contacted with a Ti-type or TiZr-type conversion coating to create the functionalization layer.

Prior to creating the functional layer (400), the prepared 7xxx aluminum alloy product may be further prepared, such as by rinsing the prepared 7xxx aluminum alloy product. To create the functional layer, the prepared 7xxx aluminum alloy product is generally exposed to an appropriate chemical, such as an acid or base. In one embodiment, the chemical is a phosphorous-containing organic acid. The organic acid generally interacts with aluminum oxide in the prepared oxide layer to form a functionalized layer. The organic acid is dissolved in water, methanol, or other suitable organic solvent, to form a solution that is applied to the 7xxx aluminum alloy product by spraying, immersion, roll coating, or any combination thereof. The phosphorus-containing organic acid may be an organophosphonic acid or an organophosphinic acid. The pretreated body is then rinsed with water after the acid application step. In another embodiment, the chemical is a Ti-type or TiZr-type conversion coating.

The term "organophosphonic acid" includes acids having the formula $R_m[PO(OH)_2]_n$ wherein R is an organic group containing 1-30 carbon atoms, m is the number of organic groups and is about 1-10, and n is the number of phosphonic acid groups and is about 1-10. Some suitable organophosphonic acids include vinyl phosphonic acid, methylphosphonic acid, ethylphosphonic acid, octylphosphonic acid and styrenephosphonic acid The term "organophosphinic acid" includes acids having the formula $R_mR'_o[PO(OH)]_n$ wherein R is an organic group containing 1-30 carbon atoms, R' is hydrogen or an organic group containing 1-30 carbon atoms, m is the number of R groups and is about 1-10, n is the number of phosphinic acid groups and is about 1-10, and o is the number of R' groups and is about 1-10. Some suitable organophosphinic acids include phenylphosphinic acid and bis-(perfluoroheptyl) phosphinic acid.

In one embodiment, a vinyl phosphonic acid surface treatment is used that forms essentially a monolayer with aluminum oxide in the surface layer. The coating areal weight may be less than about 15 mg/m$^2$. In one embodiment, the coating areal weight is only about 3 mg/m$^2$.

An advantage of these phosphorus-containing organic acids is that the pretreatment solution contains less than about 1 wt. % chromium and preferably essentially no chromium. Accordingly, environmental concerns associated with chromate conversion coatings are eliminated.

Due to the functionalization, the anodic oxide layer (40) may include phosphorous. In one embodiment, a surface phosphorous content of the anodic oxide layer is at least 0.2 mg/m$^2$ (average). As used herein, "surface phosphorus content" means the average amount of phosphorus at the surface of the anodic oxide layer (40) as measured by XRF (X-Ray Fluorescence). The area of collection should be at least 3 cm×3 cm (1.25 inches by 1.25 inches) across the functionalized surface. In one embodiment, a surface phosphorous content of the anodic oxide layer is at least 0.3 mg/m$^2$ (average). In another embodiment, a surface phosphorous content of the anodic oxide layer is at least 0.4 mg/m$^2$ (average). In yet another embodiment, a surface phosphorous content of the anodic oxide layer is at least 0.5 mg/m$^2$ (average). In another embodiment, a surface phosphorous content of the anodic oxide layer is at least 0.6 mg/m$^2$ (average). In yet another embodiment, a surface phosphorous content of the anodic oxide layer is at least 0.7 mg/m$^2$ (average). The surface phosphorous content of the anodic oxide layer is generally not greater than 4.65 mg/m$^2$ (average).

When the functionalization solution is a phosphorous-containing organic acid, the functionalization generally results in the phosphorus being bound to an organic group (R) as shown in FIG. 8*a*. In one embodiment, the organic group (R) comprises a vinyl group. Such organic binding does not occur with phosphoric acid anodizing, which generally produces P—O bonds, as shown in FIGS. 8*b*-8*c*.

In one embodiment, the anodic oxide layer (40) comprises a phosphorous concentration gradient, as measured by XPS (X-Ray Photoelectron Spectroscopy), wherein the amount of phosphorous at the surface of the anodic oxide layer (within 10 nm of the surface) ("P-surface") exceeds the amount of phosphorous at the interface ("P-interface") between the anodic oxide layer (40) and the prepared oxide layer (30). In one embodiment, the P-surface concentration, by atomic percent, is at least 10% higher than the P-interface concentration. In another embodiment, the P-surface concentration, by atomic percent, is at least 25% higher than the P-interface concentration.

The functionalized 7xxx aluminum alloy product may be cut in desired sizes and shapes and/or worked into a predetermined configuration. Castings, extrusions and plate may also require sizing, for example by machining, grinding or other milling process, and prior to the application of the methods described herein. Shaped assemblies made in accordance with the invention are suitable for many components of vehicles, including automotive bodies, body-in-white components, doors, trunk decks and hood lids. The functionalized 7xxx aluminum alloy products may be bonded to a metal support structure using a polymeric adhesive.

In manufacturing automotive components, it is often necessary to join the functionalized 7xxx aluminum alloy material to an adjacent structural member. Joining functionalized 7xxx aluminum alloy materials may be accomplished in two steps. First, a polymeric adhesive layer may be applied to the functionalized 7xxx aluminum alloy product, after which it is pressed against or into another component (e.g., another functionalized 7xxx aluminum alloy product; a steel product; a 6xxx aluminum alloy product; a 5xxx aluminum alloy product; a carbon reinforced composite). The polymeric adhesive may be an epoxy, a polyurethane or an acrylic.

After the adhesive is applied, the components may be spot welded together, e.g., in a joint area of applied adhesive. Spot welding may increase peel strength of the assembly and may facilitate handling during the time interval before the adhesive is completely cured. If desired, curing of the adhesive may be accelerated by heating the assembly to an elevated temperature. The assembly may then be passed through a paint preparation process (e.g., a zinc phosphate bath or zirconium based treatment), dried, electrocoated, and subsequently painted with an appropriate finish.

Referring now to FIG. 7, in one embodiment, after the creating step (400), the method includes bonding (702) at least a portion of the functionalized 7xxx aluminum alloy product with a "second material," thereby creating an as-bonded 7xxx aluminum alloy product. In one embodiment, the bonding (702) step may include curing (not illustrated) the adhesive bonding agent applied (704) to the at least a portion of the functionalized 7xxx aluminum alloy product and/or the at least a portion of the second material for a predetermined amount of time and/or at a predetermined temperature. The curing step may be performed concomitant to or after the applying step (704). In one embodiment, the as-bonded 7xxx aluminum alloy product may include the first portion of the 7xxx aluminum alloy product adhesively structurally bonded to the second material via the applied (704) and/or cured adhesive bonding agent. In one embodiment, at least a portion of the functionalized 7xxx aluminum alloy product includes a first portion of the functionalized 7xxx aluminum alloy product, and the second material includes at least a second portion of the functionalized 7xxx aluminum alloy product.

As used in the context of FIG. 7 and its above description, "second material" means a material to which at least a portion of an aluminum alloy product is bonded, thereby forming an as-bonded aluminum alloy product.

In one embodiment of the method, when the as-bonded 7xxx aluminum alloy product is in the form of a single-lap-joint specimen having an aluminum metal-to-second material joint overlap of 0.5 inches, the as-bonded 7xxx aluminum alloy product achieves completion of 45 stress durability test (SDT) cycles according to ASTM D1002 (10). In one embodiment, a residual shear strength of the single-lap-joint specimen after completing the 45 SDT cycles is at least 80% of an initial shear strength. In another embodiment, the residual shear strength of the single-lap-joint specimen after completing the 45 SDT cycles is at least 85% of the initial shear strength. In yet another embodiment, the residual shear strength of the single-lap-joint specimen after completing the 45 SDT cycles is at least 90% of the initial shear strength.

The method may optionally comprise one or more thermal exposure steps. For instance, purposeful thermal exposure steps may be applied before the preparing step (200), before the anodizing step (300), and/or after the creating step (400). The thermal exposure step(s) may result in the production of a thermal oxide layer on the 7xxx aluminum alloy product. In one embodiment, the total thickness of the prepared oxide layer plus the thermal oxide layer plus the anodic oxide layer is from 15-150 nanometers, as described above relative to FIGS. 5-6 and for the same reasons (e.g., to facilitate subsequent adhesive bonding).

In one embodiment, the total thickness of the prepared oxide layer plus the thermal oxide layer plus the anodic oxide layer is at least 20 nanometers. In another embodiment, the total thickness of the prepared oxide layer plus the thermal oxide layer plus the anodic oxide layer is at least 25 nanometers. In one embodiment, the total thickness of the prepared oxide layer plus the thermal oxide layer plus the anodic oxide layer is not greater than 135 nanometers thick. In another embodiment, the total thickness of the prepared oxide layer plus the thermal oxide layer plus the anodic oxide layer is not greater than 125 nanometers thick. In yet another embodiment, the total thickness of the prepared oxide layer plus the thermal oxide layer plus the anodic oxide layer is not greater than 115 nanometers thick. In another embodiment, the total thickness of the prepared oxide layer plus the thermal oxide layer plus the anodic oxide layer is not greater than 105 nanometers thick. In yet another embodiment, the total thickness of the prepared oxide layer plus the thermal oxide layer plus the anodic oxide layer is not greater than 100 nanometers thick. In another embodiment, the total thickness of the prepared oxide layer plus the thermal oxide layer plus the anodic oxide layer is not greater than 95 nanometers thick. In yet another embodiment, the total thickness of the prepared oxide layer plus the thermal oxide layer plus the anodic oxide layer is not greater than 90 nanometers thick. In another embodiment, the total thickness of the prepared oxide layer plus the thermal oxide layer plus the anodic oxide layer is not greater than 85 nanometers thick. In yet another embodiment, the total thickness of the prepared oxide layer plus the thermal oxide layer plus the anodic oxide layer is not greater than 80 nanometers thick. In another embodiment, the total thickness of the prepared oxide layer plus the thermal oxide layer plus the anodic oxide layer is not greater than 75 nanometers thick. In yet another embodiment, the total thickness of the prepared oxide layer plus the thermal oxide layer plus the anodic oxide layer is not greater than 70 nanometers thick. In another embodiment, the total thickness of the prepared oxide layer plus the thermal oxide layer plus the anodic oxide layer is not greater than 65 nanometers thick, or thinner.

In one approach, a thermal exposure may be completed before the preparing step (200) (i.e., after the receiving step (100) and before the preparing step (200)). In one embodiment, a solution heat treatment and quench (a solutionizing treatment) may be completed on as received F-temper product, after which the preparing step (200) is completed. For instance, an as-received 7xxx aluminum alloy product may be in the F-temper (as fabricated). Prior to the preparing step (200), the 7xxx aluminum alloy product may be formed into a predetermined shaped product, such as an automotive component (e.g., door outer and/or inner panels, body-in-white components (A-pillars, B-pillar, or C-pillars), hoods, deck lids, and similar components). This forming step may be completed at elevated temperatures, and may, therefore subject the 7xxx aluminum alloy product to various thermal practices (e.g., consistent with a solutionizing treatment (i.e., a solution heat treatment plus quench), when warm or hot forming and then die quenched). To further develop the strength (or other properties) of the formed 7xxx aluminum alloy product, the formed 7xxx aluminum alloy product may be artificially aged, which artificial aging may occur before the preparing step (200), before the anodizing step (300), and/or after the creating step (400). In one embodiment, one or more artificial aging steps follow a solutionizing treatment, after which the preparing step (200) is completed. In another embodiment, artificial aging is completed on an as-received W-temper or T-temper product, after which the preparing step (200) is completed. Paint baking may then occur after the creating step (400).

In one approach, a thermal exposure may be completed before the anodizing step (200) (i.e., after the preparing step (100) and before the anodizing step (200)). For instance, a solution heat treatment and quench (a solutionizing treatment) may be completed on a prepared F-temper product, after which the anodizing step (200) is completed. For instance, an as-received 7xxx aluminum alloy product may be in the F-temper (as fabricated). After the preparing step (200) and prior to the anodizing step (300), the 7xxx aluminum alloy product may be formed into a predetermined shaped product, such as an automotive component (e.g., door outer and/or inner panels, body-in-white components (A-pillars, B-pillar, or C-pillars), hoods, deck lids, and similar components). This forming step may be completed at elevated temperatures, and may, therefore subject the 7xxx aluminum alloy product to various thermal practices (e.g., consistent with a solutionizing treatment (i.e., a solution heat treatment plus quench), when warm or hot forming and then die quenched). To further develop the strength (or other properties) of the formed 7xxx aluminum alloy product, the formed 7xxx aluminum alloy product may be artificially aged, which artificial aging may occur before the anodizing step (300), and/or after the creating step (400).

In one embodiment, one or more artificial aging steps follow a solutionizing treatment, after which the anodizing step (300) is completed. In another embodiment, artificial aging is completed on an as-received W-temper or T-temper product, after which the preparing step (200) is completed. Paint baking may then occur after the creating step (400)

Any of the thermal exposure steps described above may be combined, as applicable, to complete the product. For instance, a thermal exposure may be completed both prior to preparing (200) and prior to anodizing (300). Paint baking may then occur after the creating step (400)

When utilized, the artificial aging may facilitate realization of any of an underaged, peak aged, or overaged temper. As may be appreciated, the 7xxx aluminum alloy product may be formed before an artificial aging step, or after an artificial aging step, if utilized.

The methods disclosed herein are generally applicable to 7xxx aluminum alloy products, such as those including copper resulting in the formation of copper-bearing intermetallic particles. In one approach, the 7xxx aluminum alloy product comprises 2-12 wt. % Zn, 1-3 wt. % Mg, and 0-3 wt. % Cu (e.g., 1-3 wt. % Cu). In one embodiment, the 7xxx aluminum alloy product is one of a 7009, 7010, 7012, 7014, 7016, 7116, 7032, 7033, 7034, 7036, 7136, 7037, 7040, 7140, 7042, 7049, 7149, 7249, 7349, 7449, 7050, 7150, 7055, 7155, 7255, 7056, 7060, 7064, 7065, 7068, 7168, 7075, 7175, 7475, 7178, 7278, 7081, 7181, 7085, 7185, 7090, 7093, 7095, 7099, or 7199 aluminum alloy, as defined by the Aluminum Association Teal Sheets (2015). In one embodiment, the 7xxx aluminum alloy is 7075, 7175, or 7475. In one embodiment, the 7xxx aluminum alloy is 7055, 7155, or 7225. In one embodiment, the 7xxx aluminum alloy is 7065. In one embodiment, the 7xxx aluminum alloy is 7085 or 7185. In one embodiment, the 7xxx aluminum alloy is 7050 or 7150. In one embodiment, the 7xxx aluminum alloy is 7040 or 7140. In one embodiment, the 7xxx aluminum alloy is 7081 or 7181. In one embodiment, the 7xxx aluminum alloy is 7178.

The 7xxx aluminum alloy product may be in any form, such as in the form of a wrought product (e.g., a rolled sheet or plate product, an extrusion, a forging). The 7xxx aluminum alloy product may alternatively be in the form of a shape-cast product (e.g., a die casting). The 7xxx aluminum alloy product may alternatively be an additively manufactured product. As used herein, "additive manufacturing" means "a process of joining materials to make objects from 3D model data, usually layer upon layer, as opposed to subtractive manufacturing methodologies", as defined in ASTM F2792-12a entitled "Standard Terminology for Additively Manufacturing Technologies".

The temper and 7xxx aluminum alloy definitions provided herein are per ANSI H35.1 (2009).

BRIEF DESCRIPTION OF THE DRAWINGS

FIG. 9 is a plot of X-ray photoelectron spectroscopy (XPS) oxide structure analysis results of a 7xxx aluminum alloy product treated according to one embodiment of the disclosure.

DETAILED DESCRIPTION

Example 1

Figure 1:
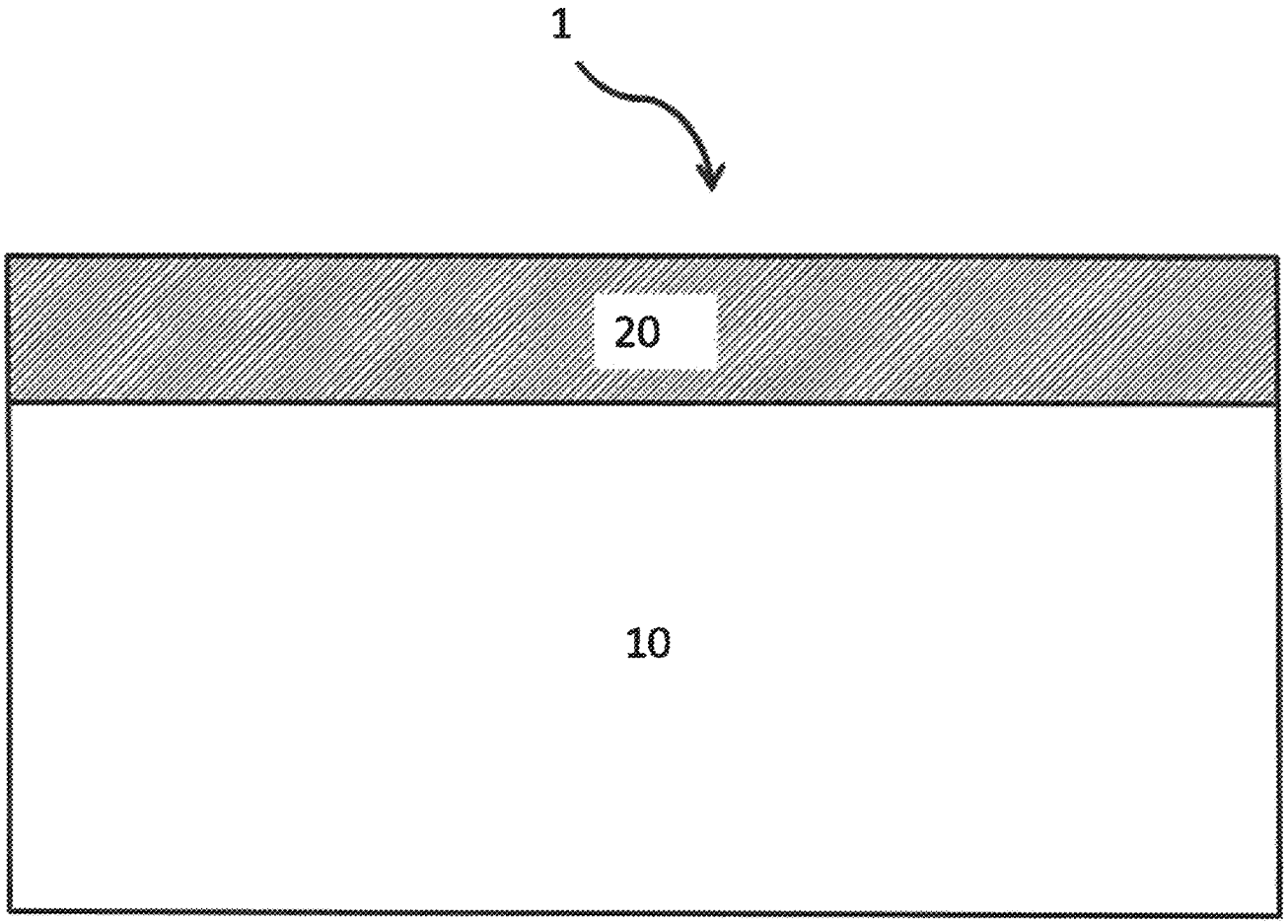
FIG. 1 is a cross-sectional schematic view of an 7xxx aluminum alloy product (1) (e.g., an as-received 7xxx aluminum alloy product) having a base (10) and surface oxides thereon (20) (not to scale; for illustration purposes only).
Figure 2:
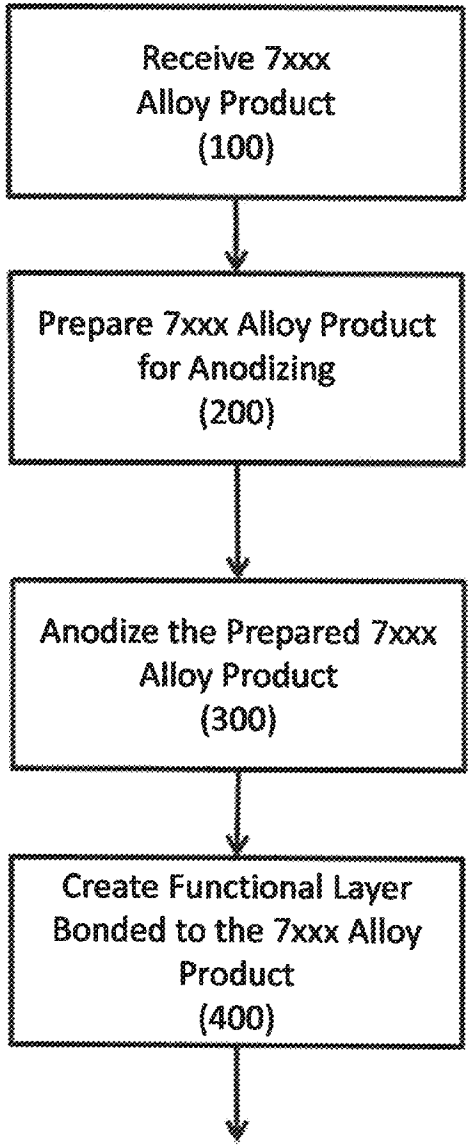
FIG. 2 is a flow chart illustrating one embodiment of a method for producing 7xxx aluminum alloy products in accordance with the present disclosure.
Figure 3:
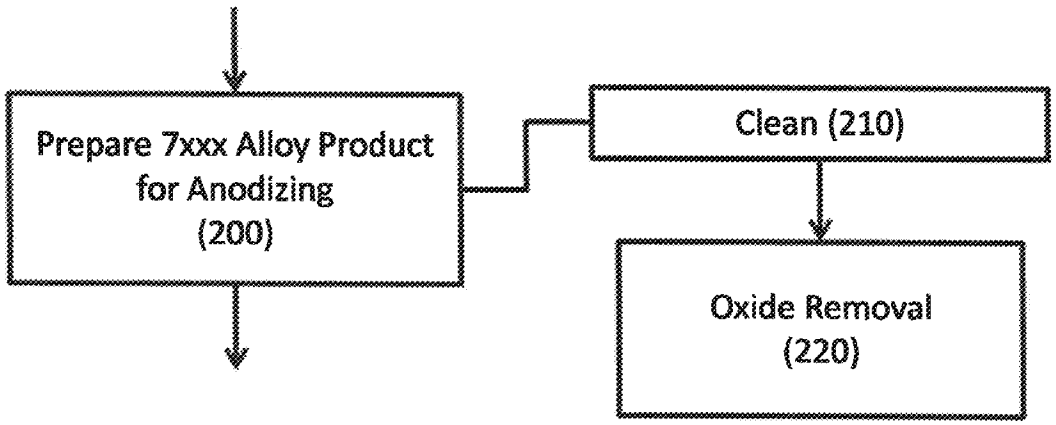
FIG. 3 is a flow chart illustrating one embodiment of the preparing step (200) of FIG. 2.
Figure 4:
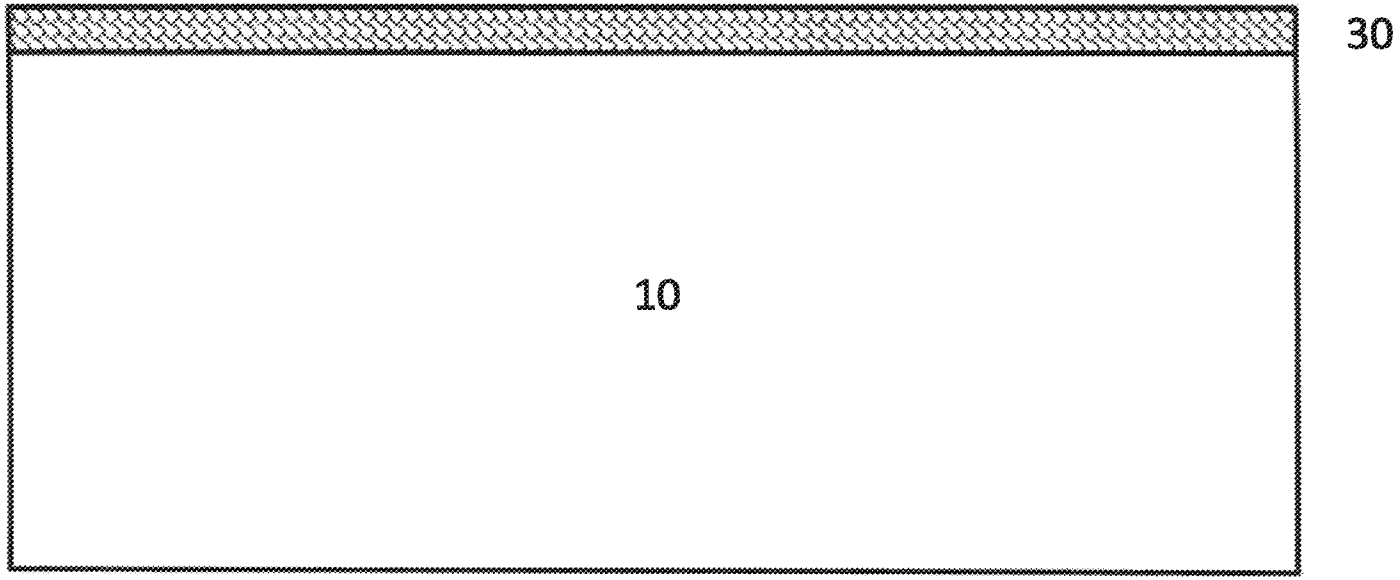
FIG. 4 is a cross-sectional schematic view of a prepared 7xxx aluminum alloy product (1) having a base (10) with prepared surface oxides (30) thereon (not to scale; for illustration purposes only).
Figure 5:
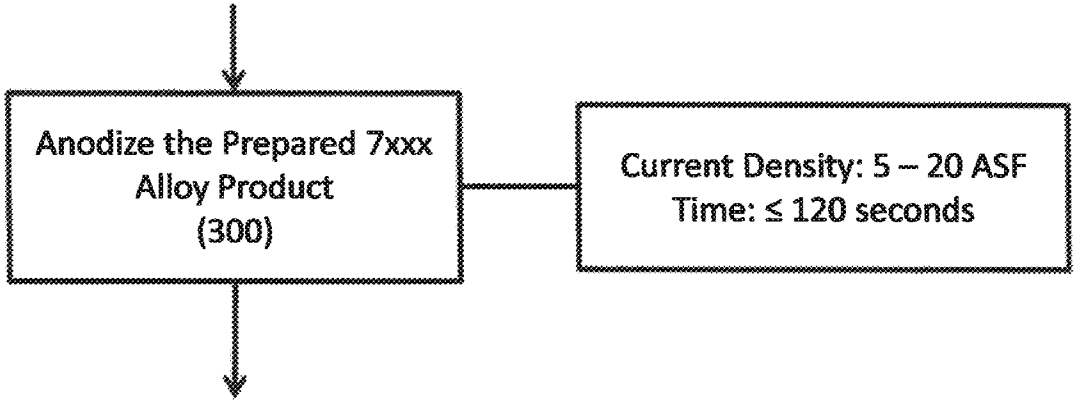
FIG. 5 is a flow chart illustrating one embodiment of the anodizing step (300) of FIG. 2.
Figure 6:
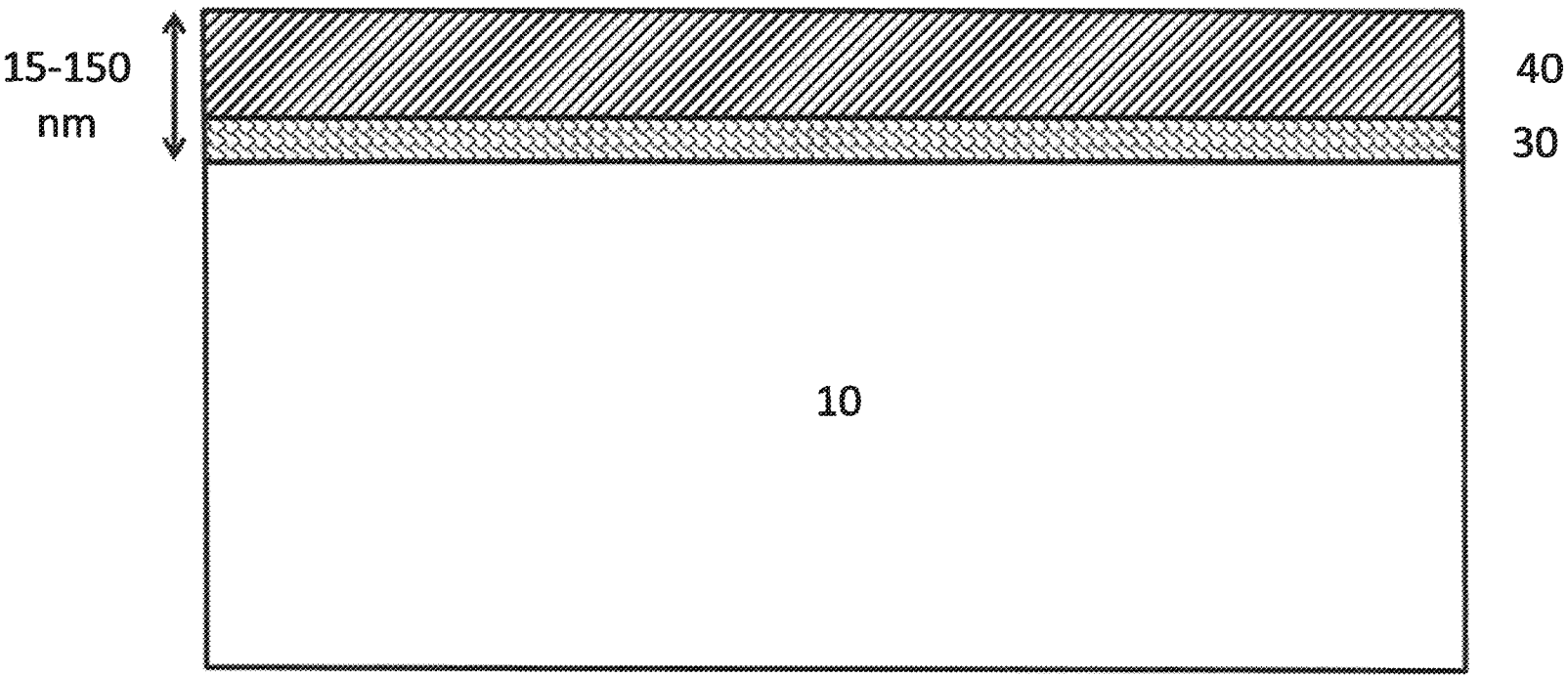
FIG. 6 is a cross-sectional schematic view of a prepared and anodized 7xxx aluminum alloy product (1) having a base (10) with prepared surface oxides (30) and anodic oxides (40) thereon (not to scale; for illustration purposes only).
Figure 7:
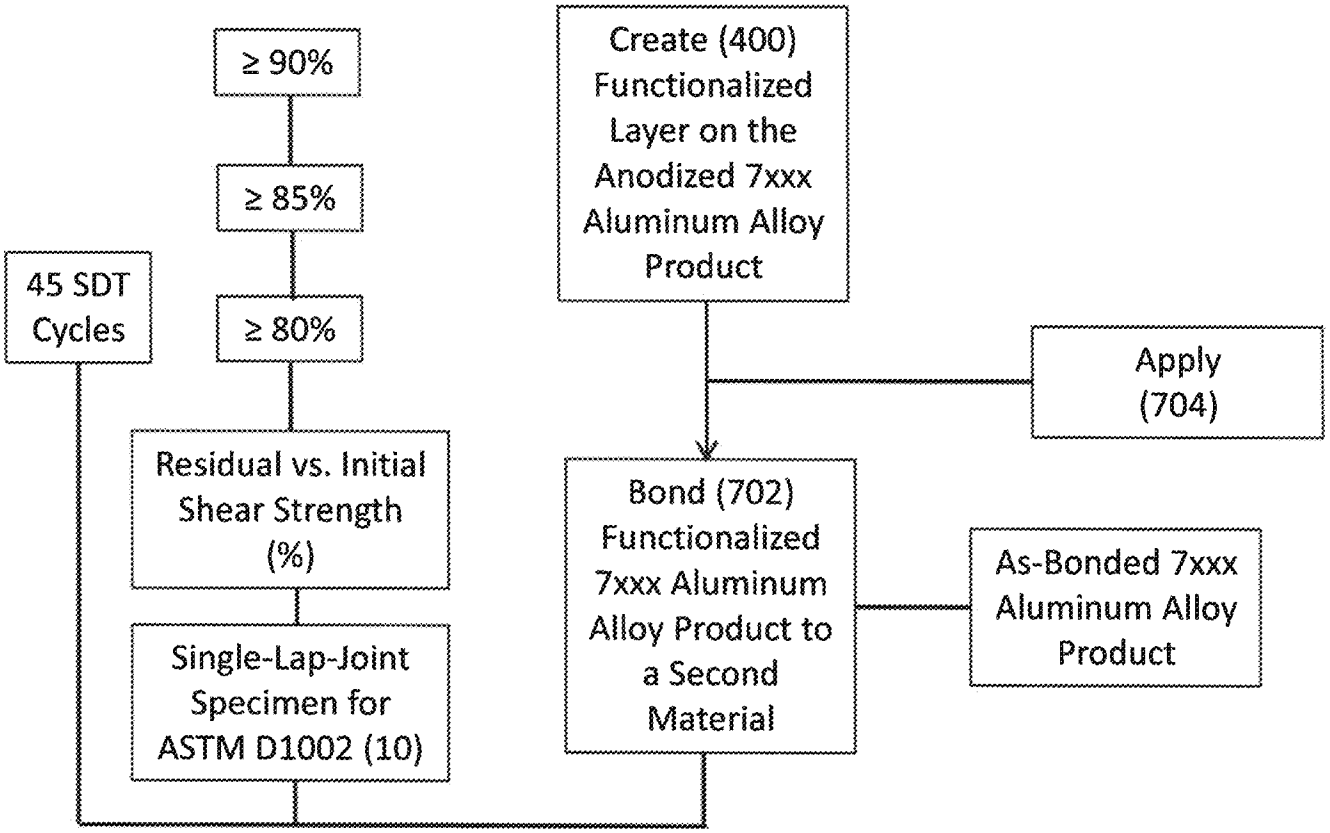
FIG. 7 is a flow chart illustrating one embodiment of the creating step (400) of FIG. 2.

Several samples of a 7xxx aluminum alloy (Al—Zn—Mg—Cu style) product were received and prepared as per step (200) of FIG. 2, above. After the preparing step (200) a native oxide layer (4-6 nm thick) was present on the surface of the sample. The 7xxx aluminum alloy products were not anodized, but, instead, were simply subjected to the creating step (400), as per FIG. 2, and in accordance with U.S. Pat. No. 6,167,609 to Marinelli et al. After the creating step, the samples were sequentially bonded and then subjected to an industry standard cyclical corrosion exposure test, similar to ASTM D1002, which continuously exposes the samples to 1080 psi lap shear stresses to test bond durability. All samples failed to complete the required 45 cycles in the bond durability test.

Example 2

Several samples of a 7xxx aluminum alloy (Al—Zn—Mg—Cu style) were processed as per FIG. 2. The alloys were all anodized in a 15 wt. % sulfuric acid solution at 70° F. and 6 ASF for 10, 45, or 60 seconds. After anodizing, a functional layer was then created (400), per FIG. 2 and in accordance with U.S. Pat. No. 6,167,609 to Marinelli et al., on each of the materials, after which the materials were sequentially bonded and then subjected to an industry standard cyclical corrosion exposure test, similar to ASTM D1002.

The samples anodized for 60 seconds successfully completed the required 45 cycles and produced retained lap shear strengths of 7253, 6600, 6851 and 7045 psi in the four replicate specimens (6937 psi, ave., with a stdev ($\sigma$) of 278 psi). These residual shear strength results are superior to the typical range of 4500-6000 psi typically observed for adhesively bonded 5xxx and 6xxx alloys prepared by another conventional industry practice. The four residual shear strength results are also consistent, as indicated by the low standard deviation. The samples anodized for only 10 or 45 seconds at 6 ASF did not successfully complete the bond durability testing. Only two of the 45 second anodized samples survived the 45 cycles, and none of the 10 second anodized samples survived the 45 cycle requirement.

As a baseline, four of the same alloy samples were prepared similarly to above, but were held for 60 seconds in the 15 wt. % sulfuric acid anodizing bath at 70° F., without any current applied. The same functional layer was then created (400), per FIG. 2 and in accordance with U.S. Pat. No. 6,167,609 to Marinelli et al., on each of the materials, after which the materials were sequentially bonded and then subjected to an industry standard cyclical corrosion exposure test, similar to ASTM D1002. All four samples failed at either 2 or 3 cycles, confirming that the anodic oxide layer produced during anodization facilitates appropriate production of the functional layer and subsequent adhesive bonding.

Example 3

Several samples of a 7xxx aluminum alloy (Al—Zn—Mg—Cu style) were processed as per FIG. 2. The alloys were all anodized in a 15 wt. % sulfuric acid solution at 70° F. and 15 ASF for 10, 20, 30, or 40 seconds. After anodizing, a functional layer was then created (400), per FIG. 2 and in accordance with U.S. Pat. No. 6,167,609 to Marinelli et al., on each of the materials, after which the materials were sequentially bonded and then subjected to an industry standard cyclical corrosion exposure test, similar to ASTM D1002. All four anodizing conditions resulted in the specimens completing the required 45 cycles, and with retained strength levels of from 3512 to 6519 psi. The average retained strengths were 5698 psi (stdev (σ) of 205 psi) (40 sec.), 5091 psi (30 sec.), 5665 psi (20 sec.), and 5167 psi (10 sec.). The higher current density (as compared to Example 2) facilitated production of an anodic oxide layer having an appropriate thickness for facilitating the creating step (400) and subsequent adhesive bonding.

Figure 10:
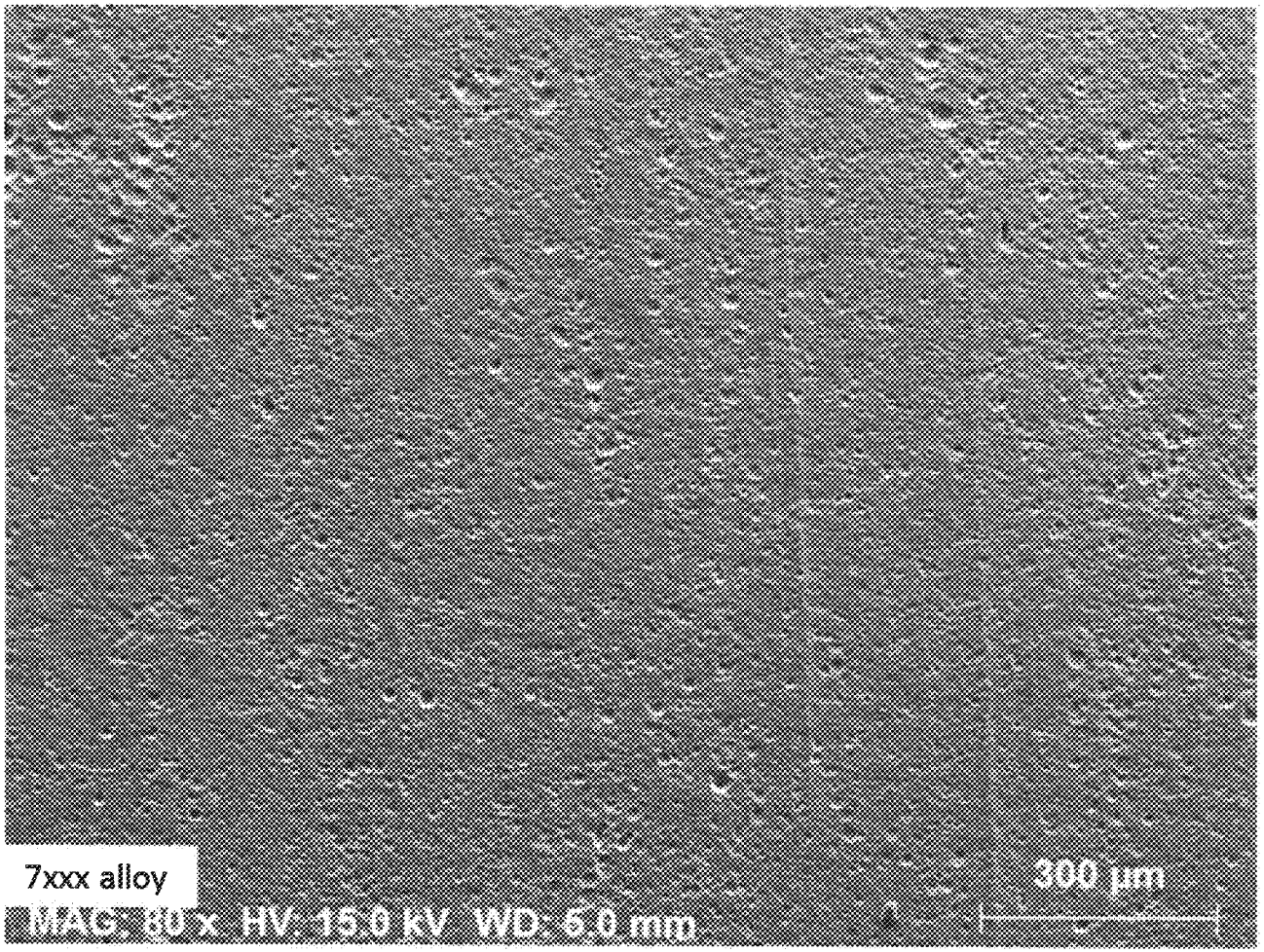
FIG. 10 is a scanning electron micrograph (SEM) image of the surface topography of the 7xxx aluminum alloy product of FIG. 9.

To verify oxide thickness, one of the 10 second anodized samples was analyzed by XPS. The analysis indicated that the anodic oxide layer had a thickness of 28 nm thick, and consisted essentially of aluminum oxides (e.g., $Al_2O_3$). See, FIG. 9. The surface of the oxide also includes a plurality of pits. See, FIG. 10. It is believed that these pits may at least assist in facilitating approved adhesive boding performance for the 7xxx aluminum alloy products.

As per Example 2, baseline samples were also prepared using the same conditions as the anodized sample, but in the absence of anodizing—the samples, instead, were placed in the 15 wt. % sulfuric acid anodizing bath at 70° F. without any current applied. The same functional layer was then created (400), per FIG. 2 and in accordance with U.S. Pat. No. 6,167,609 to Marinelli et al., on each of the materials, after which the materials were sequentially bonded and then subjected to an industry standard cyclical corrosion exposure test, similar to ASTM D1002. All samples failed within a few cycles (3-6), again confirming that the anodic oxide layer produced during anodization facilitates appropriate production of the functional layer and subsequent adhesive bonding.

To confirm that different anodizing conditions could be used with this same material, one additional sample of the material was prepared as per FIG. 2. The alloy was also anodized in a 15 wt. % sulfuric acid at 70° F., but at 6 ASF for 20 seconds. The same functional layer was then created (400), per FIG. 2 and in accordance with U.S. Pat. No. 6,167,609 to Marinelli et al., on each of the specimens, after which the materials were sequentially bonded and then subjected to an industry standard cyclical corrosion exposure test, similar to ASTM D1002. These specimens all completed the required 45 cycles, and with an average retained strength of 5032 psi.

Example 4

Several additional 7xxx aluminum alloys (Al—Zn—Mg—Cu style) were processed as per FIG. 2. The alloys were all anodized in a 15 wt. % sulfuric acid solution at 70° F. and 12 ASF for 20, 40, or 60 seconds. After anodizing, a functional layer was then created (400), per FIG. 2 and in accordance with U.S. Pat. No. 6,167,609 to Marinelli et al., on each of the materials, after which the materials were sequentially bonded and then subjected to an industry standard cyclical corrosion exposure test, similar to ASTM D1002. In this example, the specimens anodized for 40 second and 60 second did not pass the testing—there was just one "survivor" out of each of the four specimens at each condition. However, in the set anodized for 20 seconds, three of the four specimens completed the required 45 cycles and produced retained shear strengths of 3765, 5294 and 6385 psi. The fourth specimen survived 44 of the 45 cycles, but failed at the 45th cycle.

The anodic oxide layers of the 20 second and 40 second anodized sample were then analyzed by XPS. The 20 second anodized sample had an anodic oxide thickness of 72 nm, whereas the 40 second anodized sample has an anodic oxide thickness of 158 nm. These results indicate that the anodic oxide thickness must be maintained "thin" to facilitate subsequent functional layer preparation and adhesive bonding.

Example 5

Several additional samples of a 7xxx aluminum alloy (Al—Zn—Mg—Cu style) were processed as per FIG. 2, except the alloys were anodized in a 10 wt. % phosphoric acid solution at 90° F. and 17.5V for 10 seconds. After anodizing, a functional layer was then created (400), per FIG. 2 and in accordance with U.S. Pat. No. 6,167,609 to Marinelli et al., on each of the materials, after which the materials were sequentially bonded and then subjected to an industry standard cyclical corrosion exposure test, similar to ASTM D1002. In this example, three out of four of the samples completed the required 45 cycles and produced retained shear strengths of 6011, 5932, and 5596, with an average of 5846 psi (stdev (σ) of 220 psi), showing the efficacy of the treatment using phosphoric acid anodizing.

Figure 8A:
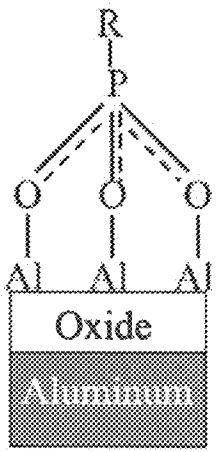
FIG. 8A is a diagram illustrating a representative chemical bond structure of an as-functionalized 7xxx aluminum alloy product following the creating step (400) of FIG. 2.
Figure 8B:
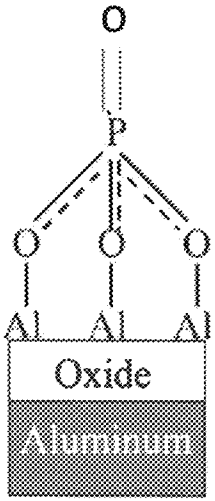
FIGS. 8B and 8C are diagrams illustrating chemical bond structures of a phosphoric acid anodizing 7xxx aluminum alloy product.
Figure 8C:
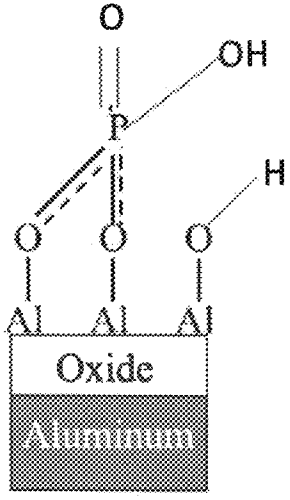

Without being bound to any particular theory, it is believed that the functionalization creates bonds between organic compounds and phosphorous in the anodic oxide layer, an example of which is FIG. 8*a*, wherein phosphorus atoms present in the functionalized layer covalently bond to an organic (R) group, in addition to being covalently bonded to oxygen atoms of the aluminum oxide. The "R groups" in the functionalized layer are generally organic groups containing 1-30 carbon atoms and/or hydrogen (i.e., R'), depending on the particular composition of the phosphorus-containing organic acid used during the creating (400) step. Phosphoric anodizing does not create such P—R boding. Instead, phosphoric anodizing generally creates P—O bonding, as illustrated in FIGS. 8*b*-8*c*. The identity of the chemical structures associated with phosphorus provides the ability to readily distinguish (e.g., using analytical methods such as Fourier-transform infra-red (FTIR) spectroscopy) between anodized and functionalized 7xxx aluminum alloy products (including, without limitation, 7xxx aluminum alloy products), as well as to characterize the compositions of the chemicals used for the various treatment steps and the degree to and conditions at which such steps have been completed.

Whereas particular embodiments of this invention have been described above for purposes of illustration, it will be evident to those skilled in the art that numerous variations of the details of the present invention may be made without departing from the invention as defined in the appending claims.

What is claimed is:

1. A 7xxx aluminum alloy product comprising:

(a) a 7xxx aluminum alloy base; and (b) an anodic oxide layer disposed on the base;

wherein the anodic oxide layer has a thickness of not greater than 100 nm;

wherein the anodic oxide layer comprises phosphorus;

wherein the anodic oxide layer has a surface phosphorus content of at least 0.2 $mg/m^2$; and wherein at least some of the phosphorus of the anodic oxide layer is covalently bonded to both (a) oxygen atoms of the anodic oxide layer and (b) at least one organic group (R).

2. The 7xxx aluminum alloy product of claim 1, wherein the surface phosphorus content is at least 0.5 $mg/m^2$.

3. The 7xxx aluminum alloy product of claim 1, wherein the surface phosphorus content of the anodic oxide layer is at least 0.70 $mg/m^2$.

4. The 7xxx aluminum alloy product of claim 1, wherein the surface phosphorus content of the anodic oxide layer is not greater than 4.65 $mg/m^2$.

5. The 7xxx aluminum alloy product of claim 1, wherein the at least one organic group (R) comprises a vinyl group.

6. The 7xxx aluminum alloy product of claim 5, wherein the 7xxx aluminum alloy product comprises a prepared oxide layer located between the 7xxx aluminum alloy base and the anodic oxide layer.

7. The 7xxx aluminum alloy product of claim 6, wherein the anodic oxide layer comprises a phosphorous concentration gradient, wherein the amount of phosphorous at the surface of the anodic oxide layer exceeds the amount of phosphorous at an interface of the anodic oxide layer and the prepared oxide layer.

8. The 7xxx aluminum alloy product of claim 7, wherein the amount of phosphorous at the surface of the anodic oxide layer is at least 10% higher than the amount of phosphorous at the interface of the anodic oxide layer and the prepared oxide layer.

9. The 7xxx aluminum alloy product of claim 7, wherein the amount of phosphorous at the surface of the anodic oxide layer is at least 25% higher than the amount of phosphorous at the interface of the anodic oxide layer and the prepared oxide layer.

10. The 7xxx aluminum alloy product of claim 6, wherein a total thickness of the prepared oxide layer plus the anodic oxide layer is less than or equal to 150 nm.

11. The 7xxx aluminum alloy product of claim 6, wherein a total thickness of the prepared oxide layer plus the anodic oxide layer is less than or equal to 125 nm.

12. The 7xxx aluminum alloy product of claim 6, wherein a total thickness of the prepared oxide layer plus the anodic oxide layer is less than or equal to 100 nm.

13. The 7xxx aluminum alloy product of claim 1, wherein the 7xxx aluminum alloy product comprises 2-12 wt. % Zn, 1-3 wt. % Mg, and 0-3 wt. % Cu.

14. The 7xxx aluminum alloy product of claim 1, wherein when bonded with a second material to form an as-bonded 7xxx aluminum alloy product, the as-bonded 7xxx aluminum alloy product achieves completion of 45 stress durability test (SDT) cycles when tested according to ASTM D1002 (10) when in a form of a single-lap-joint specimen having a joint overlap of 0.5 inches.

15. The 7xxx aluminum alloy product of claim 14, wherein a residual shear strength of the single-lap-joint specimen after completing the 45 SDT cycles is at least 80% of an initial shear strength of the single-lap-joint specimen.

16. The 7xxx aluminum alloy product of claim 14, wherein a residual shear strength of the single-lap-joint specimen after completing the 45 SDT cycles is at least 85% of an initial shear strength of the single-lap-joint specimen.

17. The 7xxx aluminum alloy product of claim 14, wherein a residual shear strength of the single-lap-joint specimen after completing the 45 SDT cycles is at least 90% of an initial shear strength of the single-lap-joint specimen.

18. The 7xxx aluminum alloy product of claim 1, wherein the surface of the anodic oxide layer includes a plurality of pits.

19. The 7xxx aluminum alloy product of claim 1, wherein the surface phosphorus content of the anodic oxide layer is at least 0.30 $mg/m^2$.

20. The 7xxx aluminum alloy product of claim 1, wherein the surface phosphorus content of the anodic oxide layer is at least 0.40 $mg/m^2$.

* * * * *